US011034489B2

(12) United States Patent
Schmidt et al.

(10) Patent No.: US 11,034,489 B2
(45) Date of Patent: Jun. 15, 2021

(54) SPILL PROOF PULL-PUSH TYPE LID ASSEMBLY FOR A BEVERAGE BOTTLE

(71) Applicants: Justin Schmidt, Costa Mesa, CA (US); Carl Jarecki, Costa Mesa, CA (US)

(72) Inventors: Justin Schmidt, Costa Mesa, CA (US); Carl Jarecki, Costa Mesa, CA (US)

( * ) Notice: Subject to any disclaimer, the term of this patent is extended or adjusted under 35 U.S.C. 154(b) by 254 days.

(21) Appl. No.: 16/416,169

(22) Filed: May 18, 2019

(65) Prior Publication Data

US 2020/0361671 A1 Nov. 19, 2020

(51) Int. Cl.

| | |
|---|---|
| ***B65D 47/24*** | (2006.01) |
| ***B65D 39/00*** | (2006.01) |
| ***A45F 3/18*** | (2006.01) |
| ***B65D 53/02*** | (2006.01) |
| ***B65D 39/08*** | (2006.01) |

(52) U.S. Cl.

CPC ..... *B65D 47/247* (2013.01); *A45F 3/18* (2013.01); *B65D 39/0076* (2013.01); *B65D 39/08* (2013.01); *B65D 53/02* (2013.01)

(58) Field of Classification Search

CPC .. B65D 47/247; B65D 51/18; B65D 51/1644; B65D 51/1661; B65D 51/1683; B65D 43/20; B65D 43/12; B65D 39/00; B65D 39/0076; B65D 39/08; B65D 2251/0012; B65D 53/02; A45F 3/18

See application file for complete search history.

(56) References Cited

U.S. PATENT DOCUMENTS

| | | | | |
|---|---|---|---|---|
| 3,123,259 | A * | 3/1964 | Musel et al. | B65D 47/242 222/521 |
| 3,785,539 | A * | 1/1974 | Wetterek | A47J 41/0027 222/552 |
| 3,809,275 | A * | 5/1974 | Ek | A47J 41/0027 215/12.1 |
| 6,095,382 | A * | 8/2000 | Gross | B65D 47/242 215/271 |
| 6,568,566 | B2 * | 5/2003 | Smith | B65D 47/243 222/153.06 |
| 6,874,664 | B1 * | 4/2005 | Montgomery | B65D 47/243 222/522 |
| 8,272,532 | B2 * | 9/2012 | Michaelian | A47G 19/2272 220/715 |
| 10,455,960 | B2 * | 10/2019 | Young | A47G 19/2272 |
| 2010/0237078 | A1 * | 9/2010 | Lentz | A47G 19/2288 220/378 |

* cited by examiner

*Primary Examiner* — Michael McCullough

(57) ABSTRACT

Presented is a spill proof pull-push type lid assembly for a beverage bottle. The lid assembly includes an inner core member, an outer core member, and other associated components configured thereon. In operation, the outer core member is configured to slide over the inner core member in a restrictive manner from a first position to a second position or vice versa to seal or open a beverage passageway from the beverage bottle to the lid, respectively.

16 Claims, 11 Drawing Sheets

SPILL PROOF PULL-PUSH TYPE LID ASSEMBLY FOR A BEVERAGE BOTTLE

CROSS-REFERENCE TO RELATED PATENT DOCUMENTS

This patent application claims the benefit of priority of U.S. Provisional Application No. 62/645,264, entitled "PULL-PUSH TYPE LID FOR A BEVERAGE BOTTLE," filed Mar. 20, 2018, which are hereby incorporated herein by reference in its entirety.

FIELD OF THE INVENTION

The present disclosure relates to the field of beverage bottles and particularly to a spill resistant lid assembly for a beverage bottle that opens and closes a fluid passageway from the bottle by a simple pull up and push down mechanism.

BACKGROUND

Varieties of drinking bottles or beverage bottles are available in the market now days and take on different configurations. Reusable drinking bottles form an important part of daily life and are used by people in various places and for various occasions including driving excursions, at home, in office, during sports, while on vacations and so on. For reusable bottles, ability to have easy access to the drinking beverage, ease of cleaning of the bottle and prevention of the drinking beverage from spilling out of the bottle while on the go are the most important attributes.

The lids used with conventional drinking bottles often utilize threads as a means for attachment to the body of the bottle. Threaded lids are generally an effective means to attaching and detaching the lid and avoiding spilling of liquids within the bottle, even when the bottle is oriented in a manner that would otherwise cause liquids to escape. A typical procedure when one desires to drink from the drinking bottle involves first removing the lid, by unthreading or unscrewing the lid from the neck of the bottle, and then holding the bottle in one hand while holding the lid in the other hand and tipping the bottle to drink from the bottle. Further, when the user is done with drinking then they are required to reverse the process to seal the lid back to the bottle. Such a standard lid mechanism is quite time consuming, when the user has to drink from the drinking bottle frequently. In addition, such bottles are open to the risk of spilling the contents out of the bottle. In a scenario where the user is running out of time and doesn't properly thread the lid back on to the neck of the bottle, there is a chance that the bottle's contents will spill and/or the contents of the bottle could become contaminated through exposure to the outside elements.

As shown in FIG. 1, there are lids available that utilize a double press mechanism, which opens up the fluid passageway from the bottle to allow the fluid to flow out of bottle on first press and seals the fluid passageway from the bottle to restrict movement of the fluid out of the bottle on second press. Although such lids may be deemed to be more convenient and provide ease of use to the user compared to the twist and release lids discussed above, such lids are still not promising in terms of effective sealing off the fluid passageway or sealing off the fluid that remains stuck within the lid body/cavity after the user sips from the lid. In addition, these mechanized lids are often times harder to clean as they contain intricate components such as springs and levers.

To overcome aforementioned problems, the present invention tends to provide a novel lid assembly for a beverage bottle that would offer ease of use, greater spill resistance, and at the same time allow easy cleaning of the interior of the lid body.

BRIEF SUMMARY

Present invention provides a spill resistant or leak proof lid for a beverage bottle that works by a simple pull up and push down mechanism.

It is an objective of the present invention to provide a lid assembly for a beverage bottle that would completely seal off a fluid passageway from the bottle restricting the movement of the fluid out of the bottle to the lid and finally outside the lid for consumption.

It is another objective of the present invention to provide a lid for a beverage bottle that would allow easy cleaning of interior of the lid body.

It is another objective of the present invention to provide a lid for a beverage bottle that would effectively restrict entry of any dust or dirt particles from environment into the lid or into a drinking area of the beverage bottle.

It is another objective of the present invention to provide a lid that would allow 360 degree flow of fluid out of lid so the user has freedom to drink from any side of the bottle.

According to the embodiments of the present invention, the proposed lid assembly includes an inner core member, an outer core member, and other associated components configured thereon. In operation, the outer core member is configured to slide over the inner core member in a restrictive manner from a first position to a second position or vice versa to seal or open a beverage passageway from the beverage bottle to the lid, respectively.

These and other features and advantages of the invention will become apparent from the detailed description below, in light of the accompanying drawings.

BRIEF DESCRIPTION OF THE ACCOMPANYING DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

FIG. 1 shows a prior art lid for a beverage bottle, flask or the like;

Figure 4A:
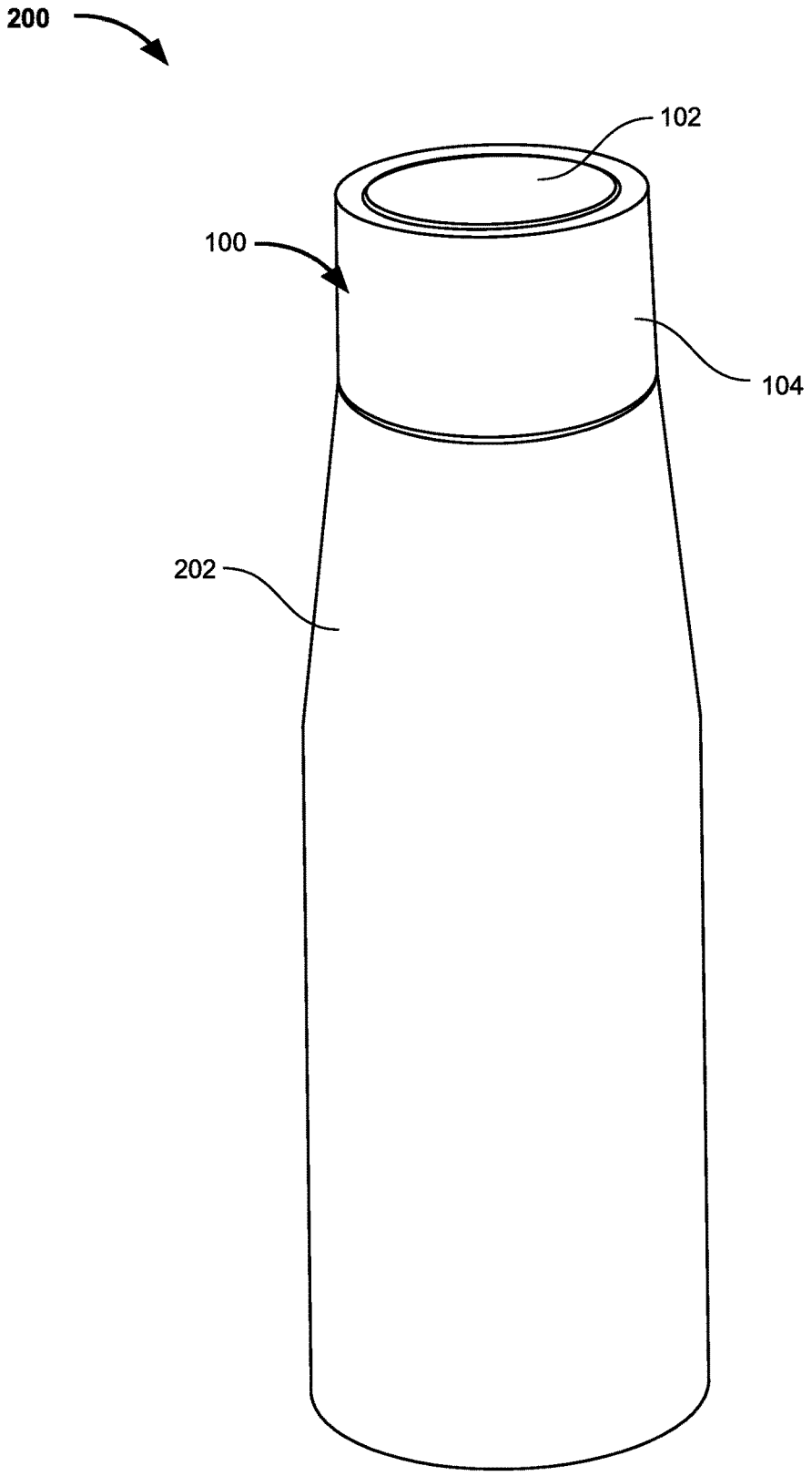
Figure 4B:
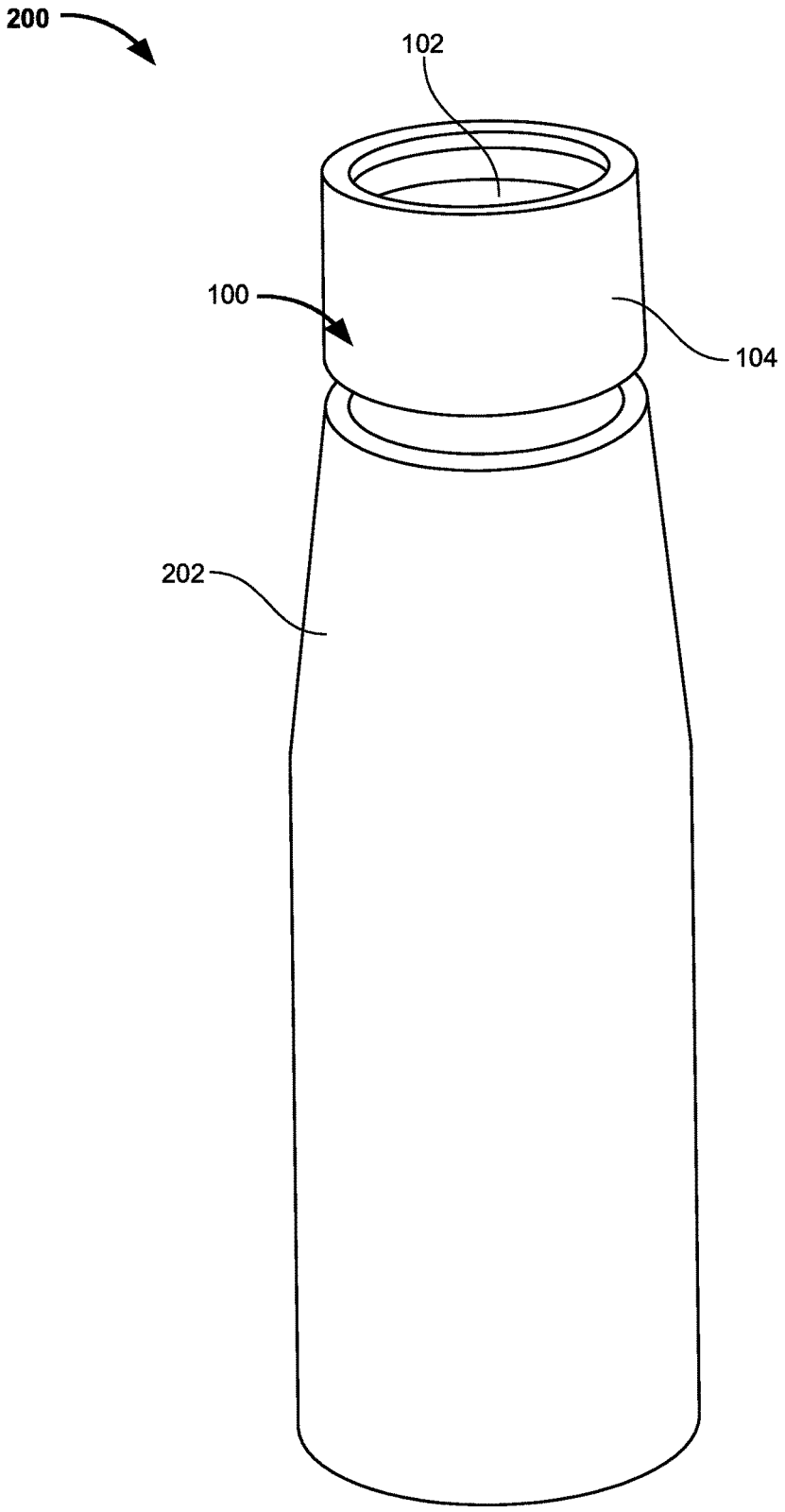

FIG. 4A shows the lid of the present invention connected over the beverage bottle with an outer core member of the lid in its first position to restrict flow of beverage from the beverage container to the lid; and FIG. 4B shows the lid of the present invention connected over the beverage bottle with the outer core member in its second position to permit flow of the beverage from the beverage container to the lid.

DETAILED DESCRIPTION

As used in the specification and claims, the singular forms "a", "an" and "the" include plural references unless the context clearly dictates otherwise. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. References to "one embodiment", "an embodiment", "another embodiment", "an example", "another example", "some embodiment", and so on, indicate that the embodiment(s) or example(s) so described may include a particular feature, structure, characteristic, property, element, or limitation, but that not every embodiment or example necessarily includes that particular feature, structure, characteristic, property, element or limitation. Unless stated otherwise, terms such as "first", "second", are used to arbitrarily distinguish between the elements such terms describe. Thus, these terms are not necessarily intended to indicate temporal or other prioritization of such elements.

Before describing the present invention in detail, it should be observed that the present invention utilizes a combination of components which constitutes a lid assembly for a beverage bottle. Accordingly, the components, their interconnectivity and operation have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention, such as the terms "lid", "lid assembly" and so on are all interchangeably used for the purpose of this invention. Further, the terms "beverage", "fluid", and so on are interchangeably used for the purpose of this invention. Further, the terms "beverage passageway", "fluid passageway", "passageway", and so on are interchangeably used for the purpose of this invention. Further, the terms "sheath of metal", "metallic sheath, and so on are interchangeably used for the purpose of this invention.

Figure 1:
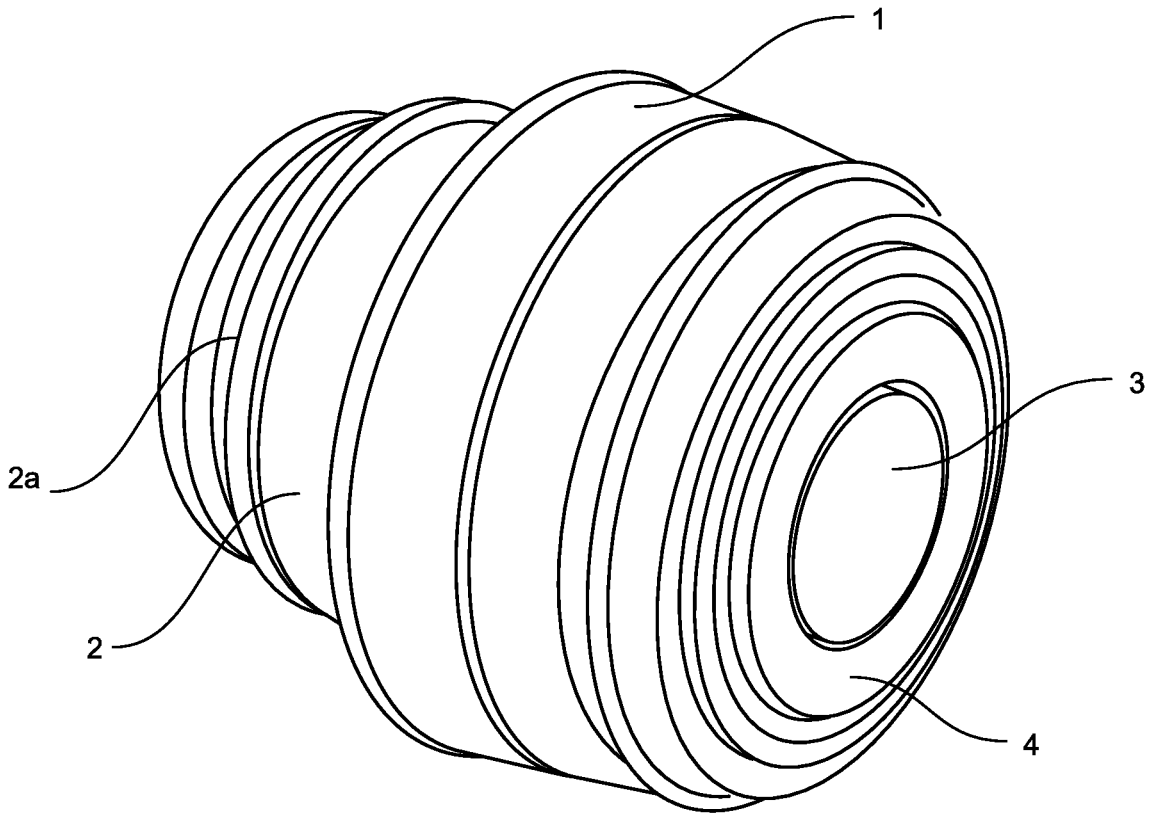
(PRIOR ART) FIG. 1

Referring to FIG. 1, there is shown a prior art exemplary lid available in the marketplace that usually works on double press mechanism to open up or close down the fluid passageway from the bottle. As seen, the lid comprises a top body portion 1 and a bottom engaging portion 2 with engaging threads 2*a*. The bottom engaging portion 2 is adapted to fit over the open mouth of a beverage bottle (not shown). Further, the top portion 1 embodies a press plate 3 centrally located and operationally engaged over the top portion 1. The lid allows the fluid to flow out of the bottle on first press of the press plate 3 during which the outer ring 4 gets elevated slightly. The lid seals the fluid passageway from the bottle to restrict movement of the fluid out of the bottle on second press of the press plate 3, which pushes back the outer ring 4 in closed position from the elevated position. Although such lids are convenient and provides ease of use to the user compared to the twist and release type lids conventionally available (as discussed in the aforementioned background). Still, the lids of type shown in FIG. 1 are not promising in terms of effective sealing off the fluid passageway or sealing off the fluid that remains stuck within the lid body which can spill out of bottle when the bottle accidently changes its orientation.

The spill proof pull-push type lid assembly of a beverage bottle of the present invention will now be described with reference to the accompanying drawings FIGS. 2-4, which should be regarded as merely illustrative without restricting the scope and ambit of the disclosure.

Referring to accompanying figures, particularly to FIGS. 2A-2E and FIGS. 3A-3D, the spill proof pull-push type lid assembly 100 (referred to as 'lid' hereafter) comprises an inner core member 106, and an outer core 109 suitably designed to engage to each other. Particularly, the inner core member 106 is configured in a way to allow the outer core member 109 to slidably and restrictively move within the inner core member 106 which will be described in greater detail in the later part of the description.

Figure 2A:
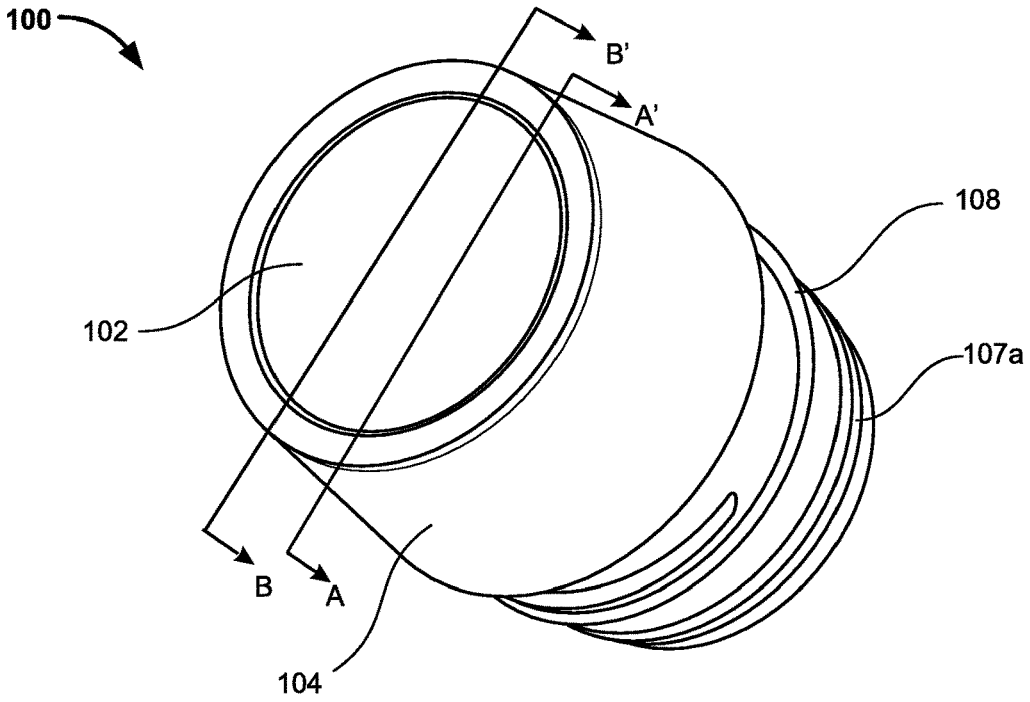
FIG. 2A shows a top perspective view of a lid assembly for a beverage bottle, according to a preferred embodiment of the present invention.
Figure 2B:
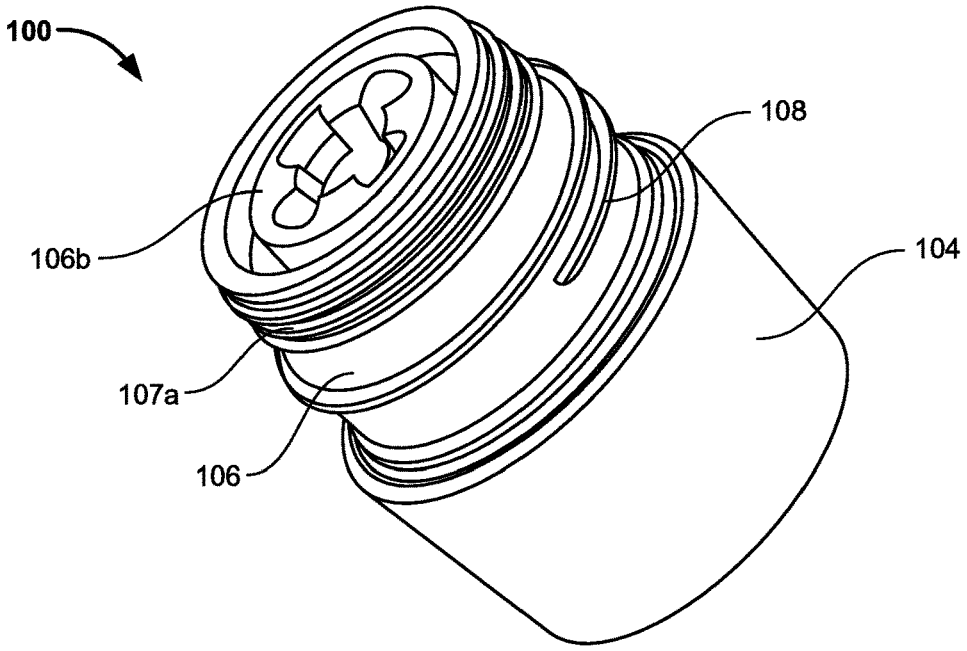
FIG. 2B-2C show bottom perspective views of the lid assembly of FIG. 2A, according to a preferred embodiment of the present invention.
Figure 2C:
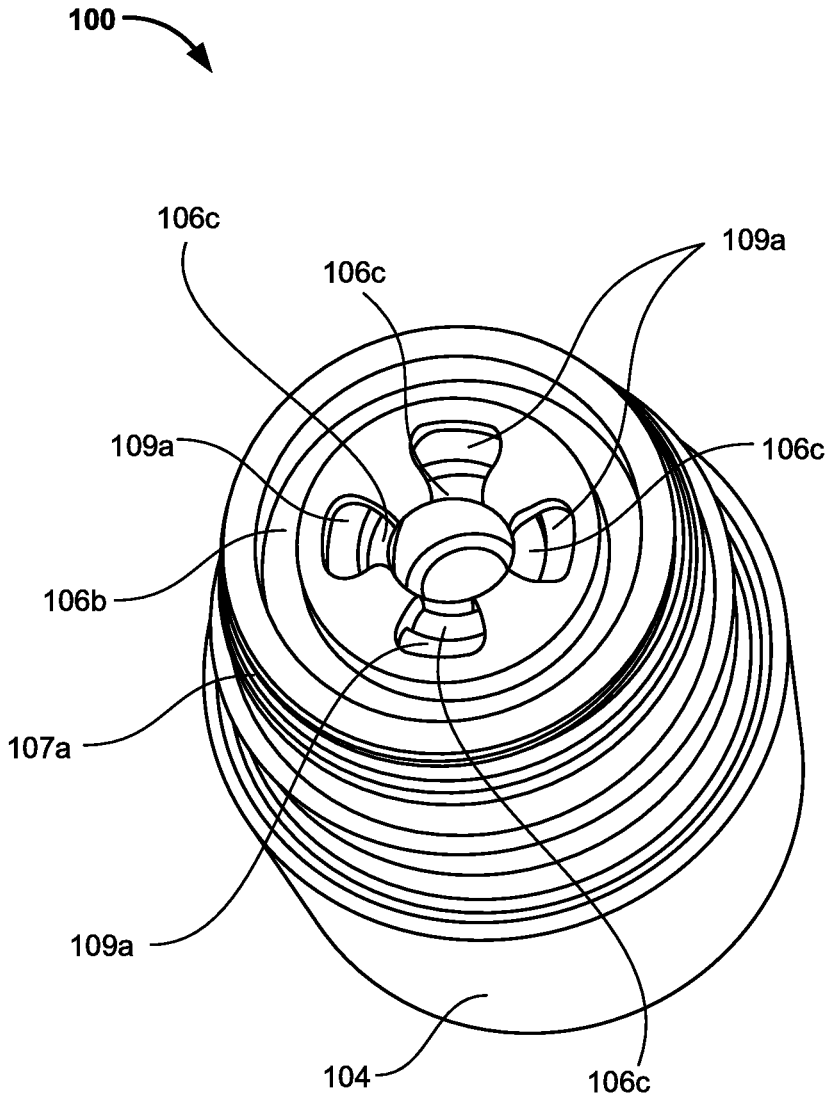
Figure 2D:
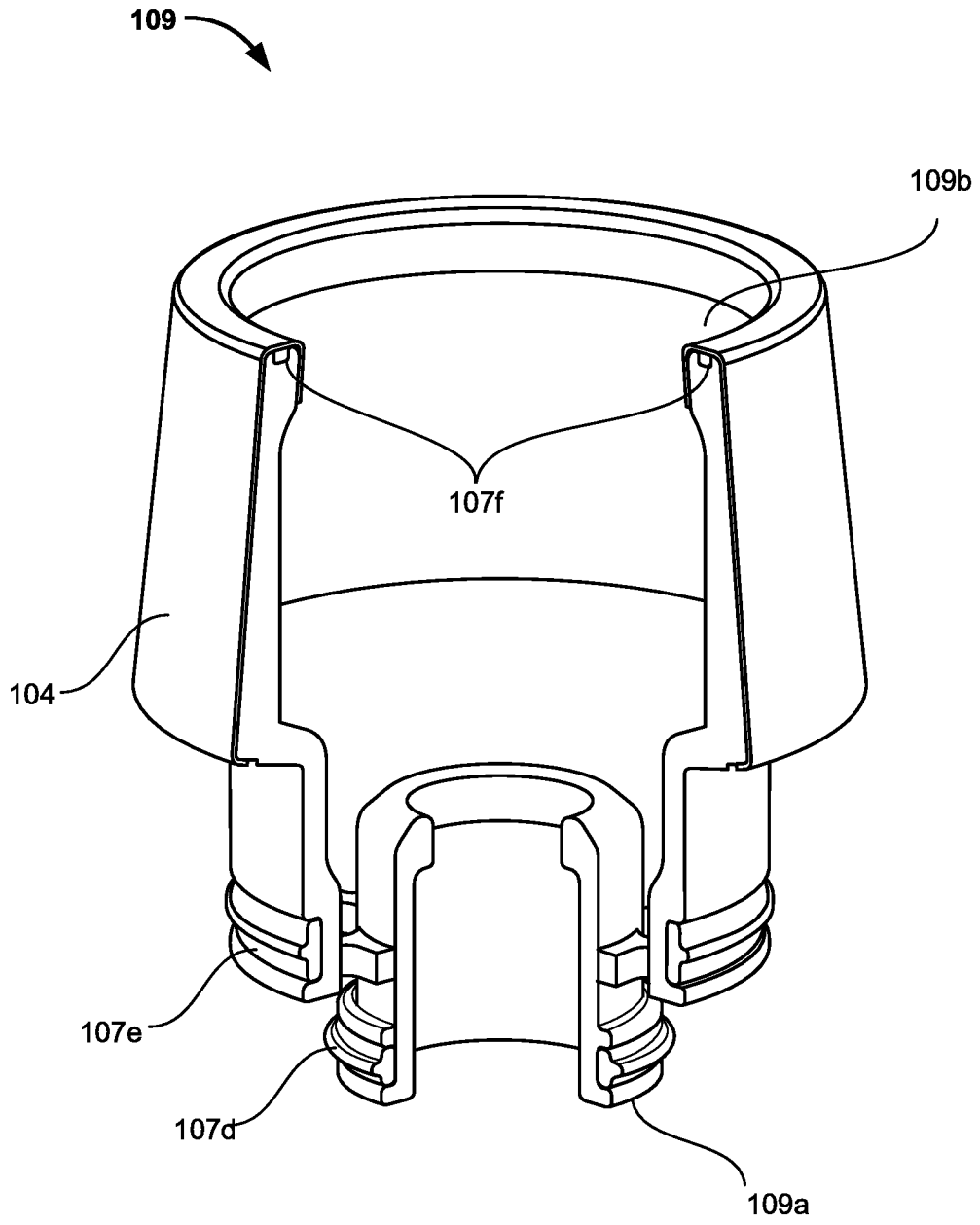
FIG. 2D shows a partial sectional view of an outer core member of the lid assembly, according to a preferred embodiment of the present invention.
Figure 2E:
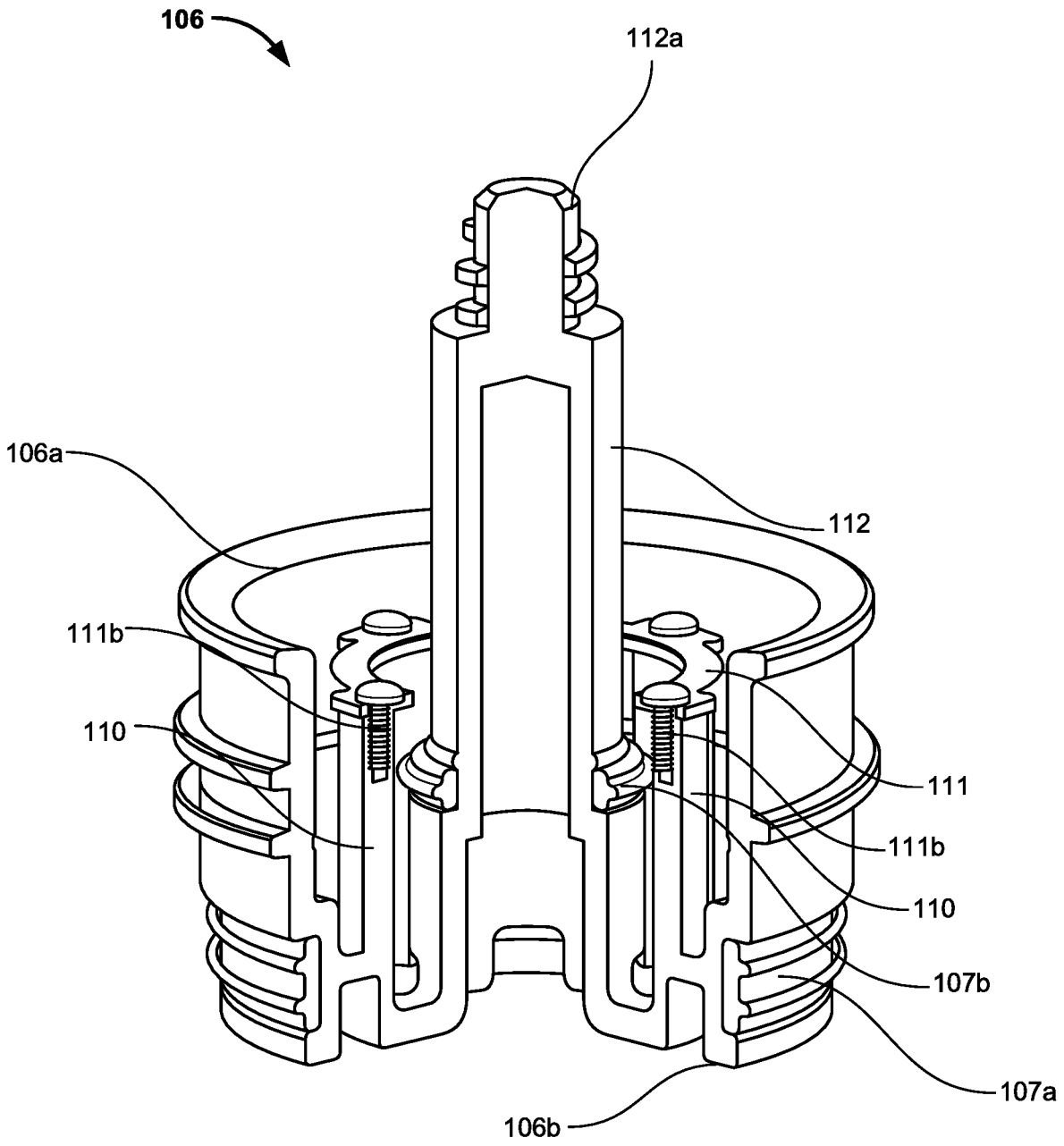
FIG. 2E shows a partial sectional view of an inner core member of the lid assembly, according to a preferred embodiment of the present invention.

The inner core member 106 is lower part of the lid assembly 100. The inner core member 106 have a top 106*a*, and a bottom 106*b* as shown in FIG. 2E. The bottom 106*b* of the lid 100 includes an internal shaft 112 located at center of the bottom 106*b*. The shaft 112 extends upward towards the top 106*a*. The bottom 106*b* of the lid 100 further includes a set of pillars 110, and a set of valves 106*c*. Each of the pillars 110 and the valves 106*c* are alternatively arranged around the shaft 112. Further, the inner core member 106 also includes a plurality of threads 108 (shown in FIG. 2B) configured on its outer surface to facilitate the lid's 100 engagement with a beverage bottle.

Figure 3A:
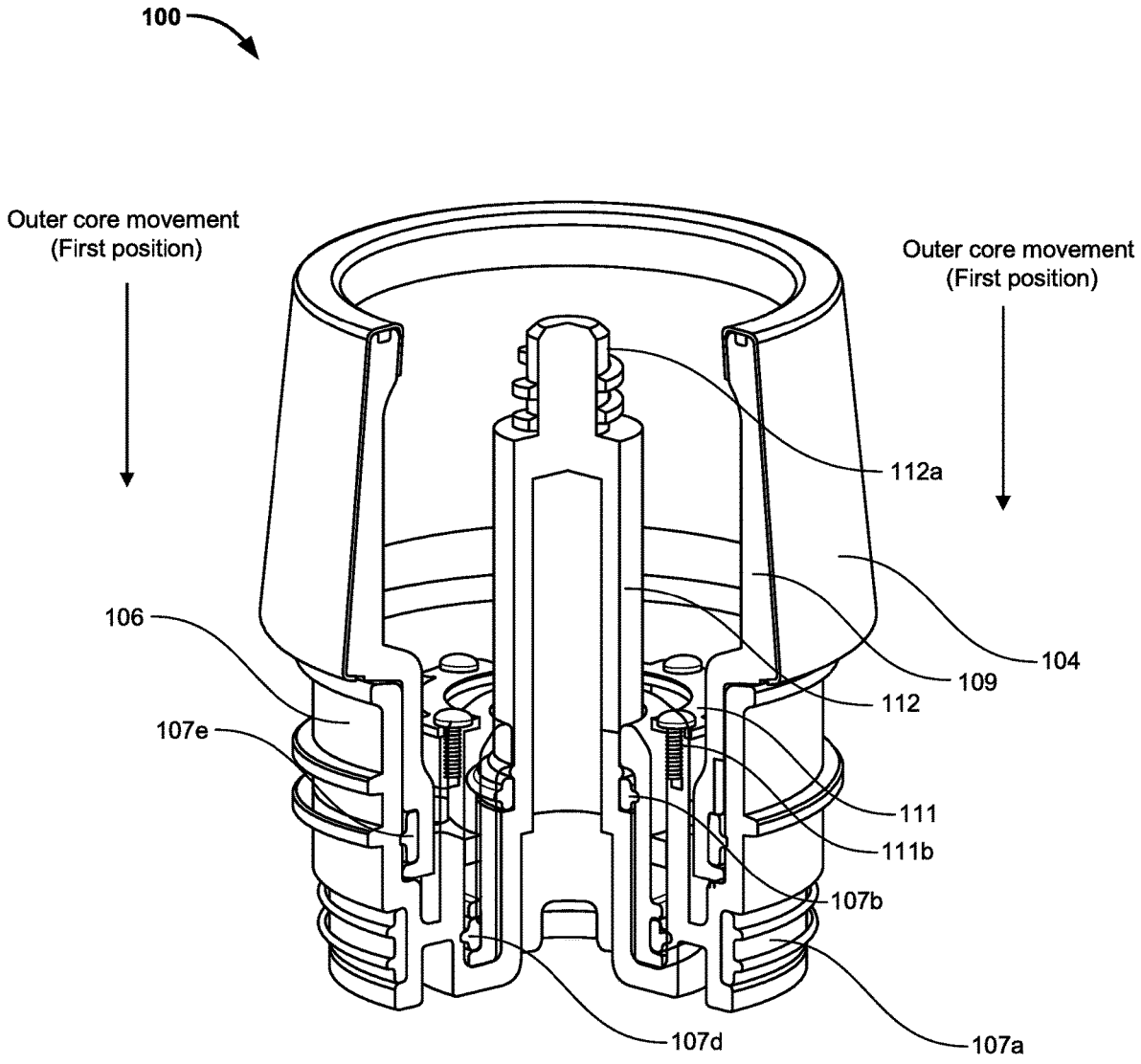
FIG. 3A shows a partial sectional view of the lid assembly of FIG. 2A taken along A-A' without a top center piece connected onto the inner core member and where the outer core member is shown configured in its first position, according to a preferred embodiment of the present invention.
Figure 3B:
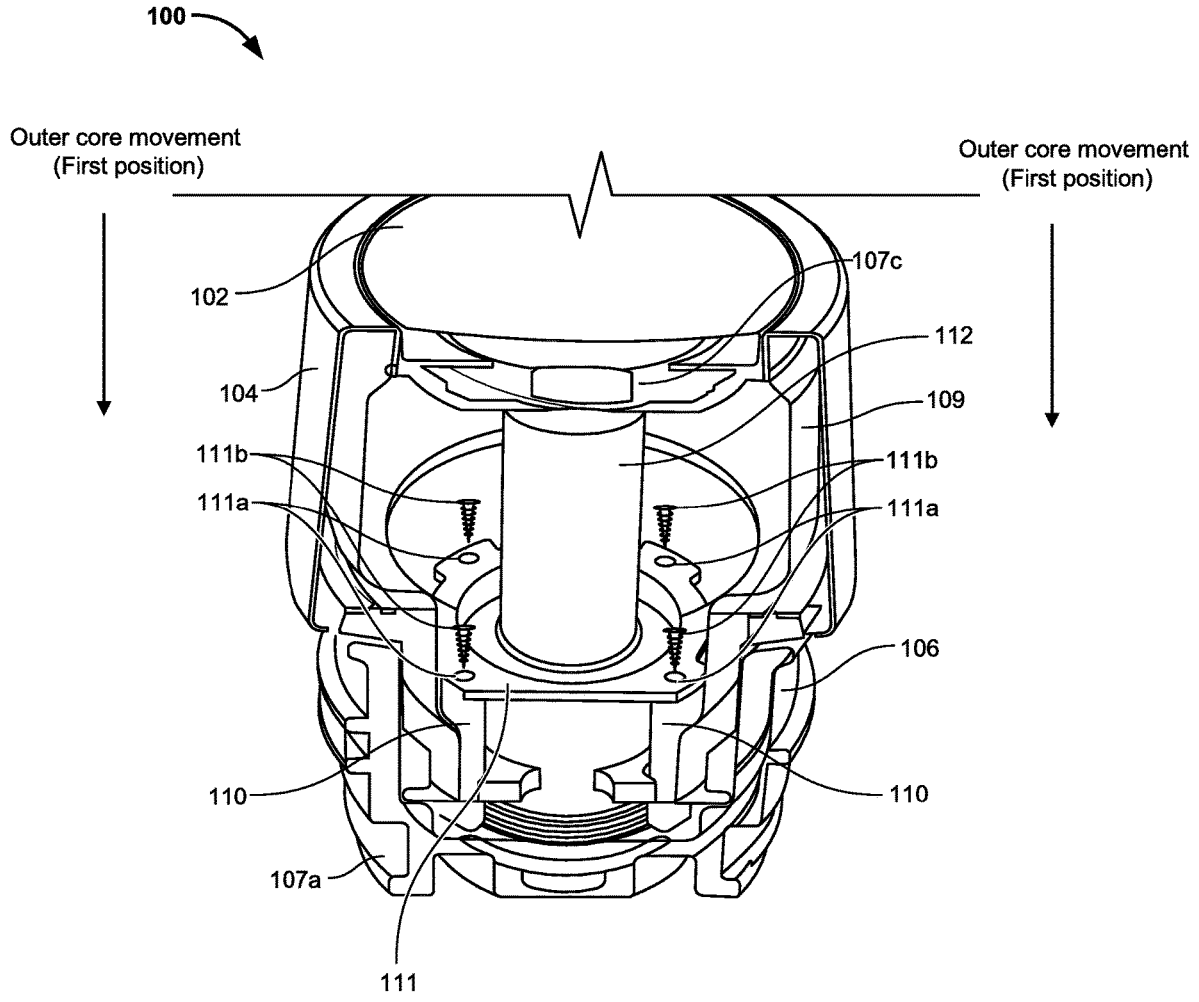
FIG. 3B shows another partial sectional view of the lid assembly of FIG. 2A taken nearly along A-A' with the top center piece connected onto the inner core member and where the outer core member is shown configured in its first position, according to a preferred embodiment of the present invention.
Figure 3C:
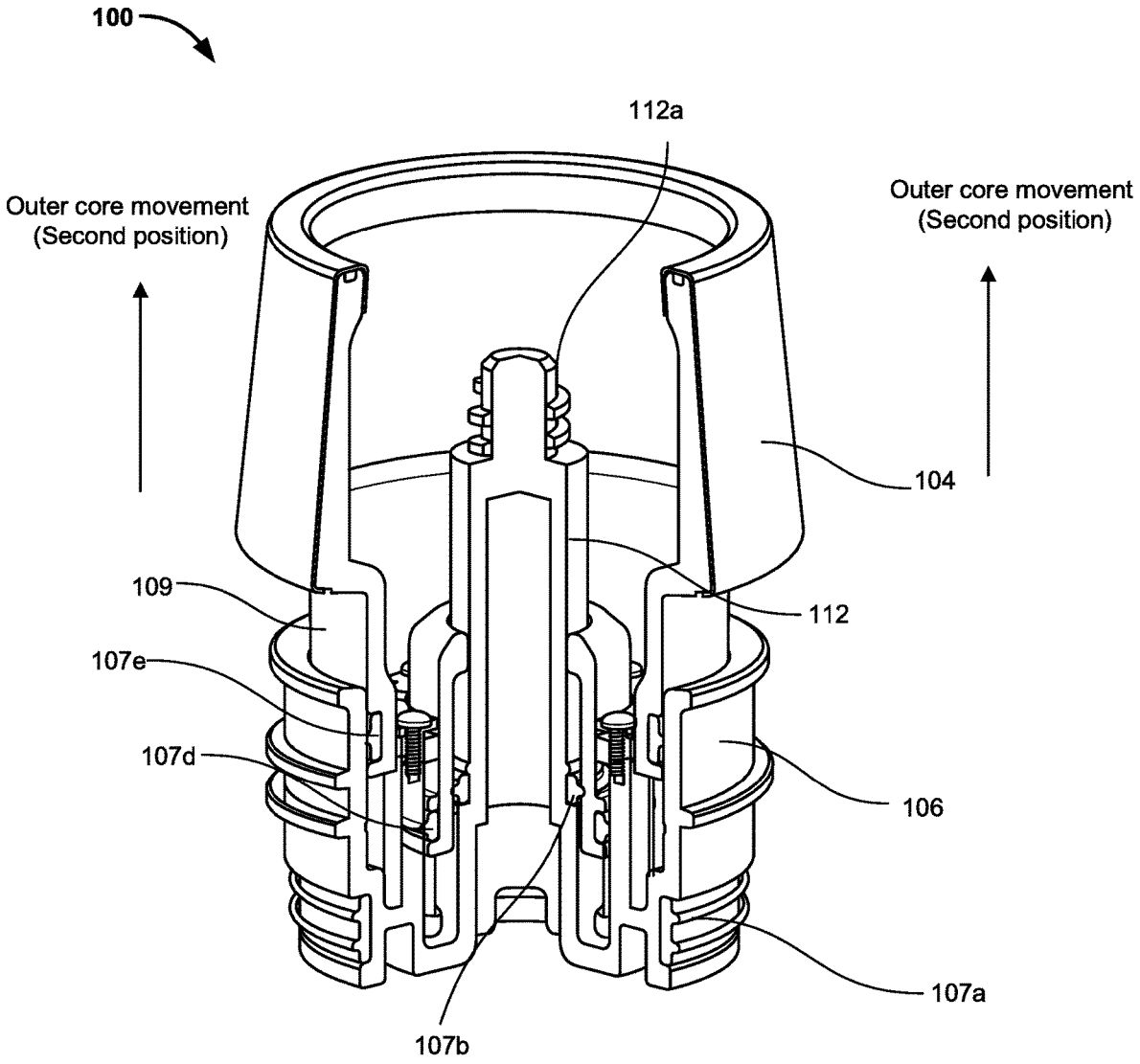
FIG. 3C shows a partial sectional view of the lid assembly of FIG. 2A taken along A-A' without the top center piece connected on top of the inner core member and where the outer core member is shown configured in its second position, according to a preferred embodiment of the present invention.
Figure 3D:
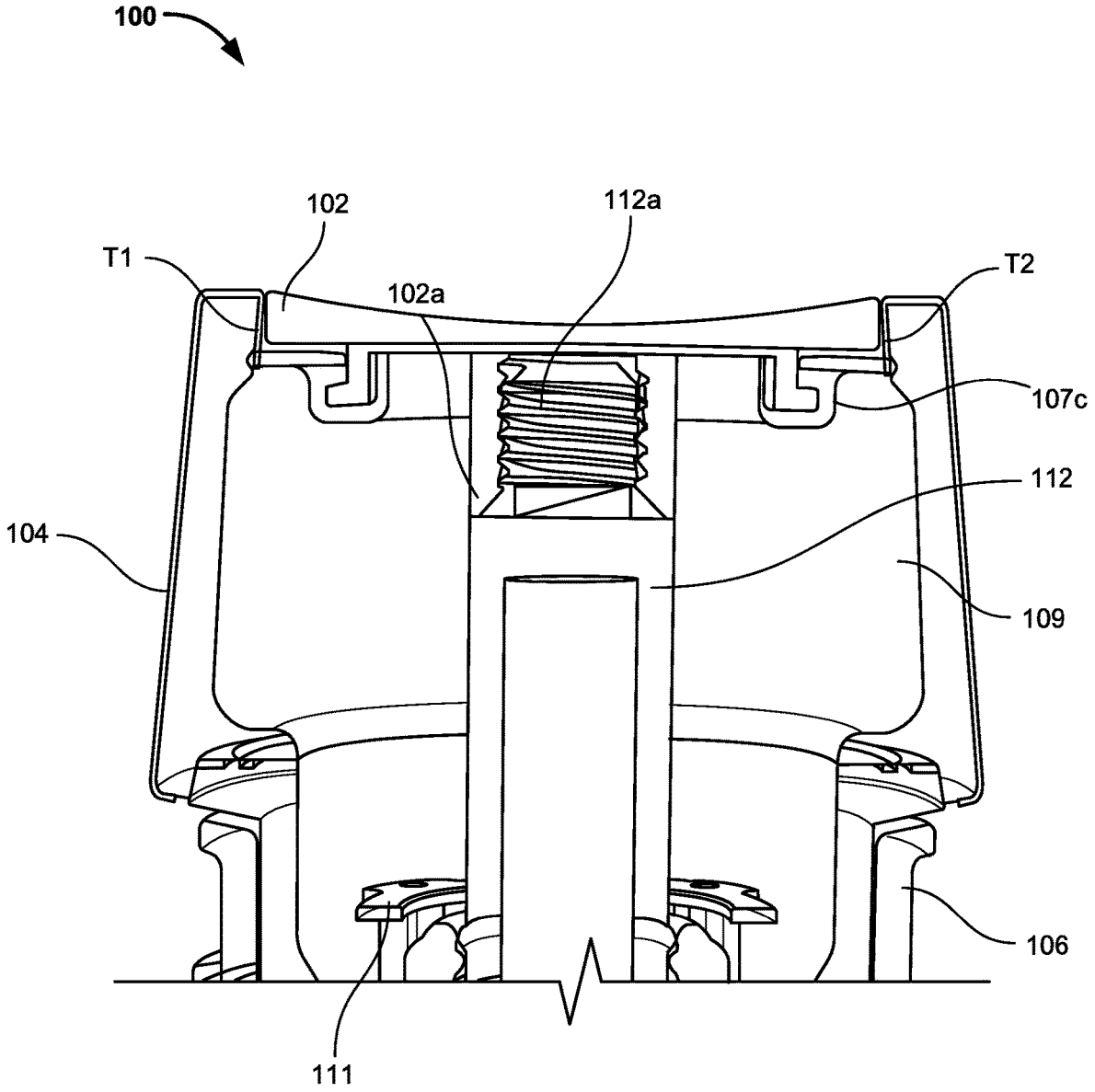
FIG. 3D shows an enlarged partial sectional view of the lid assembly of FIG. 2A taken along B-B', according to a preferred embodiment of the present invention.

The shaft 112 located internally within the inner core member 106 is configured to engage to a top center piece 102, as shown in FIGS. 3B and 3D. As seen in FIG. 3D, a free end 112*a* of the shaft 112 includes engaging threads that rotatably connects the shaft 112 to a threaded receiving structure 102*a* of the top center piece 102. Further, as seen, the shaft 112 and the receiving structure 102*a* are substantially cylindrical in shape, however, one should understand the shape of shaft 112 or the structure 102*a* can also be made different for the implementation of the proposed invention.

The set of pillars 110 (as shown in FIG. 3B or FIG. 2E) are all arranged around the shaft 112. In the preferred embodiment, the inner core member 106 includes four pillars 110 (although only two front pillars 110 are visible in FIG. 3B or FIG. 2E), it should be understood that number of such pillars 110 can vary. Further, although the pillars 110 are shown to be substantially rectangular in shape, it should be understood that the pillars 110 may be made in any other shapes such as square, triangular and so on. The term "substantially" for the purpose of this invention means equivalent or nearly equivalent as would be understood by a person skilled in the art.

The inner core member 106 further includes a stopper 111 (as shown in FIG. 3B or FIG. 2E) disposed over top of the set of pillars 110. The stopper 111 facilitates a restrictive movement to the outer core member 109 when the outer core member 109 is operated to slidably move within the inner core member 106. The stopper 111 includes slots 111*a*. The stopper 111 disposed over the top of the pillars 110 is locked therein restricting displacement of the stopper 111 when the outer core member 109 is slidably moved relative to the inner core member 106. The stopper 111 disposed over the top of the pillars 100 is locked using fastener means 111*b* such as a set of screws 111*b*. In use, once the stopper 111 is placed over the top of the pillars 110 such that the slots 111*a* on the stopper 111 gets lined up over slots (not shown) present on top end of the pillars 110, the stopper 111 is then locked by using screws 111*b* that pass through the slots 111*a* on the stopper 111 and that further go through the slots of the pillars 110. Although the screwing mechanism is disclosed for engaging the stopper 111 over top of the pillars 110, one should understand suitable design changes can be made and other different mechanism can also be used for engaging the stopper 111 on top of the pillars 110 or even the stopper 111 and the pillars 110 may be made as a one piece unit.

The inner core member 106 includes a first inner gasket 107*b* and a first outer gasket 107*a* as shown in FIG. 3A and FIG. 2E. The inner gasket 107*b* facilitates a tight fit to the inner core member 106 with the outer core member 109, prevent beverage passage between the inner core member 106 and the outer core member 109, and a smooth sliding between the inner core member 106 and the outer core member 109. The outer gasket 107*a* facilitates a tight fit to the lid 100 over the beverage bottle, and prevent passage of beverage from the beverage bottle to the lid 100 or the inner core member 106.

The outer core member 109 includes a bottom 109*a* and a top 109*b*. The outer core member 109 includes a second inner gasket 107*d*, and a second outer gasket 107*e* as shown in FIG. 2D and FIG. 3A. The inner gasket 107*d* and the outer gasket 107*e* provides a tight fit to the outer core member 109 with the inner core member 106, and restrict any beverage flow within the lid 100.

In some embodiment, the inner core member 106 further includes one or more notch or bump (not shown) present internally within the inner core member 106 on the side of the shaft 112. The bump may interact with the inner gasket 107*b* of the inner core member 106 to notify the user about the closure and opening of the lid 100, when the user pushes or pulls the lid 100 respectively. The notification may be in the form of swift sound.

In an embodiment, the outer core member 109 is rolled over with a sheath of metal 104 on outer surface of the outer core member 109 such as to give an ergonomic appearance to the lid 100. The metallic sheath 104 may be made of any suitable metal known in the art such as stainless steel. The metallic sheath 104 rolled over the outer surface of the outer core member 109 is non-porous thus facilitating easy cleaning and safer drinking of the beverage compared to other prior art lids which are made of purely plastic porous material. The sheath of metal 104 when embodied over the outer surface of the outer core member 109 function together with the outer core member 109 and acts as a place of grip for a user to operate the outer core member 109 from a first position to a second position or vice-versa. The sheath of metal 104 covering the outer core member 109 is slightly tapered at a portion (T1, T2) shown in FIG. 3D. The tapering of the sheath of metal 104 provides a tight gap between the metal sheath 104 and the top center piece 102 when the top center piece 102 is engaged to the free end 112*a* of the shaft 112. The tight gap so formed restricts entry of dust or dirt particles from environment to the lid 100 or a drinking area when the outer core member 109 is moved from the first position to the second position. The inner tapered design of the metal sheath 104 allows a level of variance/"play" in the outer core member 109. Due to the inner tapering of the metal sheath 104 at the portion (T1, T2), the outer core member 109 and the inner core member 106 don't get hung up resulting in an uninterrupted slide movement relative to each other, when the user pushes/pulls the metal sheath 104 (or so to say the outer core member 109) to open or close the fluid passageway from the beverage bottle to the lid 100.

The first position of the outer core member 109 refers to the position when the outer core member 109 is in a relaxed position or in fully in position as shown in FIGS. 3A and 3B. During the first position, the outer core member 109 seals the valves 106*c* present in the inner core member 106 to restrict beverage flow from the beverage bottle to the lid 100 (as best seen in FIG. 2C). This sealing is achieved by pushing the outer core member 109 vertically in a downward direction. The second position of the outer core member 109 refers to the position when the outer core member 109 opens the valves 106*c* present on the inner core member 106 to allow the beverage flow from the beverage bottle to the lid 100 which is achieved by pulling the outer core member 109 vertically in an upward direction as shown in FIG. 3C.

As shown in FIGS. 3B and 3D, the lid assembly 100 further includes a gasket 107*c*. The gasket 107*c* tightly fits on the top of the outer core member 109 surrounding the threaded receiving structure 102*a* of the top center piece 102 to further seal any leftover beverage stuck inside the lid 100 after the consumption of the beverage from the beverage bottle. The gasket 107*c* is easily removable. The user can easily unscrew the top center part 102 from the shaft 112 of the inner core member 106 and remove the gasket 107*c* for easy cleaning of the area inside the lid 100 with water or using other cleaning agents such as soap water and then place the gasket 107*c* again and screw the top center part 102 over the shaft 112. The outer peripheral of the gasket 107*c* makes connection with the outer core 109 to prevent any excess liquid from coming out of the lid 100 that may be left behind within the lid 100 after uses and prevent the left over water from flowing out of small drink gap when the beverage bottle is tipped over and/or placed upside down. For example, the user after consuming the beverage such as water from the beverage bottle may close the lid 100 by a push action and put the bottle in his gym bag or travel bag. The peripheral of the gasket 107*c* ensures the drink gap is fully sealed so no fluid drips out of the lid body. The gasket 107*c* also prevents external dust or dirt particles from entering into the lid 100.

As shown in FIG. 2D, the lid assembly 100 further includes a gasket 107*f*. The gasket 107*f* is configured within a plastic groove or groove (not shown) on the top of the outer core member 109. The gasket 107*f* further prevents any beverage from getting up and over the edges and in-between the outer core member 109, and the metal sheath 104. Another function the gasket 107*f* is to prevent the stainless steel sheath 104 from rotating separate from the outer core member 109 while twisting the lid 100 to on/off the bottle.

In operation, when the outer core member 109 is moved from the first position to the second position, the outer core member 109 can have a restricted upward movement that allows fluid passage from the bottle to the lid body. The upward movement of the outer core member 109 is actuated by the user by grabbing the sheath of metal 104 embodied outside of the outer core member 109 and pulling it upward that partially disengages the outer core member 109 from the inner core member 106. The upward movement of the outer core member 109 is restricted by the presence of the pillars 110 and the stopper 111 configured on top of the pillars 110 internally within the inner core member 106.

Referring to FIG. 4A, the lid 100 connected over the beverage bottle 200 with an outer core member 109 of the lid 100 in its first position is shown. As seen, the lid 100 is shown in a closed position. The lid's 100 closed position over the bottle's neck means the outer core member 109 is in its first position or relaxed position that seals the fluid from flowing out from the beverage container 202 (part of the beverage bottle 200 holding the beverage) to the lid 100. In the first position, the user operates or pushes the outer core member 109 vertically in a downward direction. During this position, the lower or bottom 109*a* of the outer core member 109 seals the bottom 106*b* of the inner core member 106 (particularly seals the valves 106*c*) restricting the fluid flow from the beverage container 202 to the lid 100, as shown in FIG. 2C.

Referring to FIG. 4B, the lid 100 connected over the beverage bottle 200 with the outer core member 109 in its second position is shown. As seen, the lid 100 is shown in an opened position. The lid's 100 opened position over the bottle's neck means the outer core member 109 is in its second position or restrictively pulled backward to allow fluid from flowing out from the beverage container 202 to the lid 100. In the second position, the user pulls the outer core member 109 vertically in an upward direction. During this position, the bottom 109*a* of the outer core member 109 opens up the bottom of the inner core member 106 (particularly opens the valves 106*c*) allowing fluid flow from the beverage container 202 to the lid 100.

The lid or lid assembly of the present invention including associated components thereof (the inner core member, the outer core member, the gaskets, the metal sheath etc) may be made using suitable metals or plastic, or ABS material or any other material or any combinations thereof and in variety of dimensions or sizes as needed. The gaskets as described above may be made of plastic, silicon or rubber material or any other like material. The use of material should not be construed as any limitation for implementation of the present invention; however the material is desired to have good durability and at the same time is inexpensive for the production and affordability of the end users.

Although particular embodiments of the invention have been described in detail for purposes of illustration, various modifications and enhancements may be made without departing from the spirit and scope of the invention.

We claim:

1. A lid assembly (100) for a beverage bottle (200), comprising:

an inner core member (106) having a top (106*a*), and a bottom (106*b*), the bottom comprising a shaft (112) centrally located and extending upward towards the top (106*a*), a set of pillars (110), and a set of valves (106*c*) configured thereon, wherein each of the set of pillars (110) and each of the set of valves (106*c*) are alternatively arranged around the shaft (112);

an outer core member (109) having a bottom (109*a*) and a top (109*b*), the outer core member (109) slidably engages with the inner core member (106) and operated to move from a first position to a second position or vice-versa, wherein the first position of the outer core member (109) leads to sealing of the plurality of valves (106*c*) located at the bottom (106*b*) of the inner core member (106), and the second position of the outer core member (109) leads to opening of the plurality of valves (106*c*) located at the bottom (106*b*) of the inner core member (106);

a top center piece (102) with a threaded receiving structure (102*a*); and a stopper (111) disposed over top of the set of pillars (110) to facilitate a restrictive movement to the outer core member (109) when the outer core member (109) is operated to move from the first position to the second position.

2. The lid assembly (100) of claim 1, wherein the inner core member (106) comprises a plurality of threads (108) configured on its outer surface to facilitate the lid's (100) engagement with the beverage bottle (200).

3. The lid assembly (100) of claim 1, wherein the shaft (112) comprises a plurality of engaging threads configured at a free end (112*a*) thereof, wherein the free end (112*a*) rotatably connects the shaft (112) to the threaded receiving structure (102*a*) of the top center piece (102).

4. The lid assembly (100) of claim 1, wherein the shaft (112) and the threaded receiving structure (102*a*) of the top center piece (102) are cylindrical.

5. The lid assembly (100) of claim 1, wherein the stopper (111) disposed over the top of the set of pillars (110) is locked therein restricting displacement of the stopper (111) when the outer core member (109) is slidably moved from the first position to a second position relative to the inner core member (106).

6. The lid assembly (100) of claim 5, wherein the stopper (111) disposed over the top of the set of pillars (100) is locked therein using fastener means (111*b*).

7. The lid assembly (100) of claim 1, wherein the inner core member (106) further comprising a first outer gasket (107*a*) that facilitates a tight fit of the lid (100) over the beverage bottle (200), and prevents passage of beverage from the beverage bottle (200) to the inner core member (106) or the lid (100); and a first inner gasket (107*b*) that facilitates a tight fit to the inner core member (106) with the outer core member (109), prevent beverage passage between the inner core member (106) and the outer core member (109), and facilitates a smooth sliding function between the inner core member (106) and the outer core (109).

8. The lid assembly (100) of claim 1, wherein the outer core member (109) comprising a second inner gasket (107*d*), and a second outer gasket (107*e*) that provides a tight fit to the outer core member (109) with the inner core member (106), and restrict any beverage flow within the lid (100).

9. The lid assembly (100) of claim 1, wherein the first position of the outer core member (109) that seals the plurality of valves (106*c*) to restrict beverage flow from the beverage bottle (200) to the lid (100) is achieved by pushing the outer core member (109) vertically in a downward direction.

10. The lid assembly (100) of claim 1, wherein the second position of the outer core member (109) that opens the plurality of valves (106*c*) to allow the beverage flow from the beverage bottle (200) to the lid (100) is achieved by pulling the outer core member (109) vertically in an upward direction.

11. The lid assembly (100) of claim 1, wherein the outer core member (109) is rolled over with a sheath of metal (104) on outer surface such as to give the lid (100) an ergonomic appearance, and wherein the sheath of metal (104) acts as a place of grip for a user to operate the outer core member (109) from the first position to the second position or vice-versa.

12. The lid assembly (100) of claim 11, wherein the sheath of metal (104) covering the outer core member (109) is slightly tapered at a portion (T1,T2) where the sheath of metal (104) is rolled over the outer core member (109).

13. The lid assembly (100) of claim 12, wherein the tapering of the sheath of metal (104) provides a tight gap between the metal sheath (104) and the top center piece (102) when the top center piece (102) is engaged to the free end (112*a*) of the shaft (112).

14. The lid assembly (100) of claim 13, wherein the tight gap so formed restricts entry of dust or dirt particles from environment to the lid (100) or a drinking area when the outer core member (109) is moved from the first position to the second position.

15. The lid assembly (100) of claim 1 further comprising a gasket (107*c*) that tightly fits on the top of the outer core member (109) surrounding the threaded receiving structure (102*a*) of the top center piece (102) to further seal any leftover beverage stuck inside the lid (100) after the consumption of the beverage from the beverage bottle (200).

16. The lid assembly (100) of claim 1 further comprising a gasket (107*f*) configured within a groove on the top of the outer core member (109) to prevent any beverage from getting up and over the edges and in-between the outer core member (109), and the metal sheath (104), and prevent the metal sheath (104) from rotating separate from the outer core member (109) while twisting the lid assembly (100).

* * * * *